US006911010B2

(12) United States Patent
Dirks et al.

(10) Patent No.: US 6,911,010 B2
(45) Date of Patent: Jun. 28, 2005

(54) HEATED MASSAGER WITH MASSAGING LIQUID DISPENSER

(75) Inventors: Keith Dirks, Sterling, IL (US); James McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 147 days.

(21) Appl. No.: 10/037,964

(22) Filed: Dec. 21, 2001

(65) Prior Publication Data

US 2003/0120185 A1 Jun. 26, 2003

(51) Int. Cl.[7] ..... A61H 7/00; A61H 15/02; A61H 23/02

(52) U.S. Cl. ..... 601/15; 601/17; 601/72

(58) Field of Search ..... 601/15, 17, 70, 601/72, 73, 80; 401/183, 155, 158, 160, 161, 205, 1, 2

(56) References Cited

U.S. PATENT DOCUMENTS

| | | | | | |
|---|---|---|---|---|---|
| 2,285,105 | A | * | 6/1942 | Bacher | 601/113 |
| 2,385,501 | A | * | 9/1945 | Fevas | 601/17 |
| 2,787,998 | A | * | 4/1957 | Grossi et al. | 601/17 |
| 3,752,155 | A | | 8/1973 | Blinoff, Jr. et al. | 128/65 |
| 3,754,548 | A | * | 8/1973 | McGrath | 601/154 |
| 4,427,001 | A | * | 1/1984 | Kiefer et al. | 601/17 |
| 5,336,159 | A | * | 8/1994 | Cheng | 601/15 |
| 6,511,445 | B2 | * | 1/2003 | Sivan et al. | 601/6 |

FOREIGN PATENT DOCUMENTS

| | | | | |
|---|---|---|---|---|
| DE | 3139848 A1 | | 4/1983 | |
| DE | 3905517 C1 | | 3/1990 | |
| DE | 03905517 | * | 3/1990 | 601/17 |
| FR | 1057283 A | * | 3/1954 | 601/80 |
| JP | 3-162871 | | 7/1991 | |
| JP | 2002-35138 | | 2/2002 | |
| WO | WO 92/14435 | | 9/1992 | |

* cited by examiner

*Primary Examiner*—Danton DeMille
(74) *Attorney, Agent, or Firm*—Greer, Burns & Crain, Ltd.

(57) ABSTRACT

A hand-held massager includes a housing having a gripping portion and a body-contacting portion, the housing being configured for emitting a massaging liquid and the body-contacting portion being configured for emitting heat to a target surface. The massager also emits a vibration and the amount of vibration is variable, as is the amount of heat and the amount of emitted massaging liquid. A pump is disposed within the housing for dispensing the massaging liquid, and a removable reservoir is in fluid communication with the pump. The reservoir is pivotably mounted to the massager between an operational position in which the reservoir is inclined relative to the body-contacting portion, and a refill position in which the body-contacting portion is placed in a generally vertical position and the reservoir is in a generally parallel position relative to the body-contacting portion.

17 Claims, 3 Drawing Sheets

HEATED MASSAGER WITH MASSAGING LIQUID DISPENSER

BACKGROUND OF THE INVENTION

The present invention relates generally to hand-held powered massagers, and specifically to such a massager which dispenses heat and a massaging liquid, in addition to preferably providing vibration as well.

A multitude of massaging devices can be found on the market. Conventional massagers typically provide heat and/or vibration as a massaging force. Such units are also known to be provided with controls to vary the amount of heat and/or massaging action to suit user requirements.

Aromatic and therapeutic massaging liquids, which include oils, lotions and creams, typically are applied by hand. This practice is messy, but provides a therapeutic benefit from the warmth and/or heat from the hand, which enhances the massaging and therapeutic benefits of the massaging liquid.

It has been found that when massaging liquid is preheated, the heat is rapidly dissipated over the skin surface, and thus provides few therapeutic benefits. If the temperature of the massaging liquid is increased, there is a risk of localized burning on the recipient's skin. However, until now, there have been no massagers which provide heat, massage and a fluid dispensing system in one compact hand-held unit.

A drawback of conventional heated and/or vibrating massagers is that when powered by a line cord, the cord is awkward and gets in the way of the massaging action. When such units are battery powered, they have a limited running time due to the power draw of the heater and/or the vibrator motor.

Another drawback of conventional hand-held massagers is that when a massaging liquid dispenser is used, there is a tendency to spill the liquid on the unit, which makes it difficult to securely hold. If the liquid seeps into the unit, internal damage may result.

Still another problem with conventional liquid dispensing massaging units is that there is no way to accurately dispense the massaging liquid upon the skin. The liquid is merely poured onto the skin or onto the massager's hand. Very often too much liquid is dispensed, which enhances the messiness of the unit described above.

Thus, a first object of the present invention is to provide an improved hand-held massager which emits heat and a massaging liquid, preferably in combination with vibration.

Another object of the present invention is to provide an improved hand-held massager which includes an easily removable massaging liquid reservoir which can be remotely filled to minimize spillage and/or seepage.

Yet another object of the present invention is to provide an improved hand-held massager with a manually controllable massaging liquid dispensing system for accurately dispensing desired amounts of massaging liquid.

Still another object of the present invention is to provide an improved rechargeable battery-operated massager which provides heat, vibration, emitted massaging liquid, and which runs for about 40 minutes with a single battery charge.

A further object of the present invention is to provide an improved hand-held massager which features a built-in massaging fluid dispensing pump.

BRIEF SUMMARY OF THE INVENTION

The above-listed objects are met or exceeded by the present heated massager with massaging liquid dispenser.

Preferably, the present massager is a hand-held device that simultaneously massages with varying heat and vibration settings or a combination thereof and applies a beneficial massaging liquid or fluid to the skin surface. While being particularly adapted for body usage, other suitable applications are contemplated. The present unit is preferably DC battery rechargeable with an external transformer, but other configurations are contemplated, including, but not restricted to line cord powered, non-rechargeable batteries, or other conventional appliance power sources.

Also featured on the present massager is a threaded removable bottle reservoir internal to the outer massager shell. The reservoir is accessible by removing a reservoir cover to replace or refill the bottle. To facilitate the removal and refilling of the reservoir, it is received in a pivoting mount which allows the reservoir to assume a generally vertical position upon the placement of the massager in a generally vertical position.

Another feature of the present massager is a finger-operated, manually rotated pump actuator wheel preferably located on the top center of the unit. Rotation of the actuator wheel dispenses the massaging fluid out the bottom of the device next to or adjacent the heated applicator pad. Depending on the viscosity or nature of the massaging fluid to be dispensed, the present pump unit will incorporate a different number of rotating roller lobes or different diameter of flexible hose to meter the desired fluid amount to the surface of the skin.

The present massager also utilizes a seal and vibration-damping gasket located between upper and lower portions of the outer shell to decrease vibration to the user's hand and also to detour liquid from entering the inside of the device. Still another feature of the present massager is that a lower portion of the device next to the heated applicator surface incorporates a pocket in which various massaging enhancement pads may be fastened or interchanged depending on the application and the device model. Further, the present massager is configured so that a single power unit powers the vibration motor and the heater, and if a rechargeable unit is provided, the running time of the unit is approximately 40 minutes per charge.

More specifically, the present invention provides a hand-held massager including a housing having a gripping portion and a body-contacting portion, the housing being configured for emitting a massaging liquid and the body-contacting portion being configured for emitting heat to a target surface. In a preferred embodiment, the massager also emits a vibration and the amount of vibration is variable, under user control, as is the amount of heat and the amount of emitted massaging liquid. A pivoting reservoir mount is located within the housing and is configured for retaining a supply of the massaging liquid and is pivotable between an operating position and a refill position.

In another embodiment, the present invention provides a hand-held massager including a housing having a gripping portion and a body-contacting portion, the housing being configured for emitting a massaging liquid and the body-contacting portion being configured for emitting heat to a target skin surface. The housing encloses a pump and a massage liquid reservoir. The pump is in fluid communication with the reservoir and is provided with manual volume control of the dispensed massaging liquid. The body-contacting portion includes a heated applicator pad which is generally planar and fixed to the body-contacting portion. A vibration generator is disposed in the housing in operational proximity to the body-contacting portion, and a thumbwheel is associated with the housing for controlling the pump, the pump being disposed within a chamber defined by the thumbwheel.

In a further embodiment, the present invention provides a hand-held massager including a housing having a gripping portion and a body-contacting portion, the housing being configured for emitting a massaging liquid and the body-contacting portion being configured for emitting heat to a target skin surface. A pump is disposed within the housing for dispensing the massaging liquid, and a removable reservoir is in fluid communication with the pump. The reservoir is pivotably mounted to the massager between an operational position in which the reservoir is inclined relative to the body-contacting portion, and a refill position in which the body-contacting portion is placed in a generally vertical position and the reservoir is in a generally parallel position relative to the body-contacting portion.

DETAILED DESCRIPTION OF THE INVENTION

Figure 1:
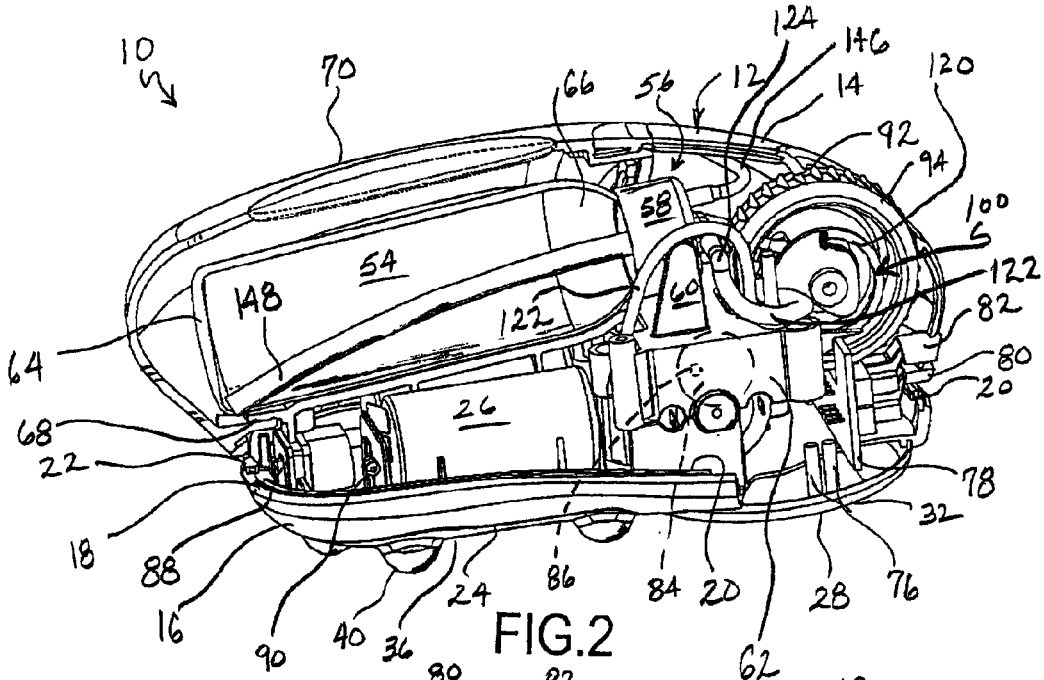
FIG. 1 is a fragmentary side elevational view of the present massager.
Figure 2:
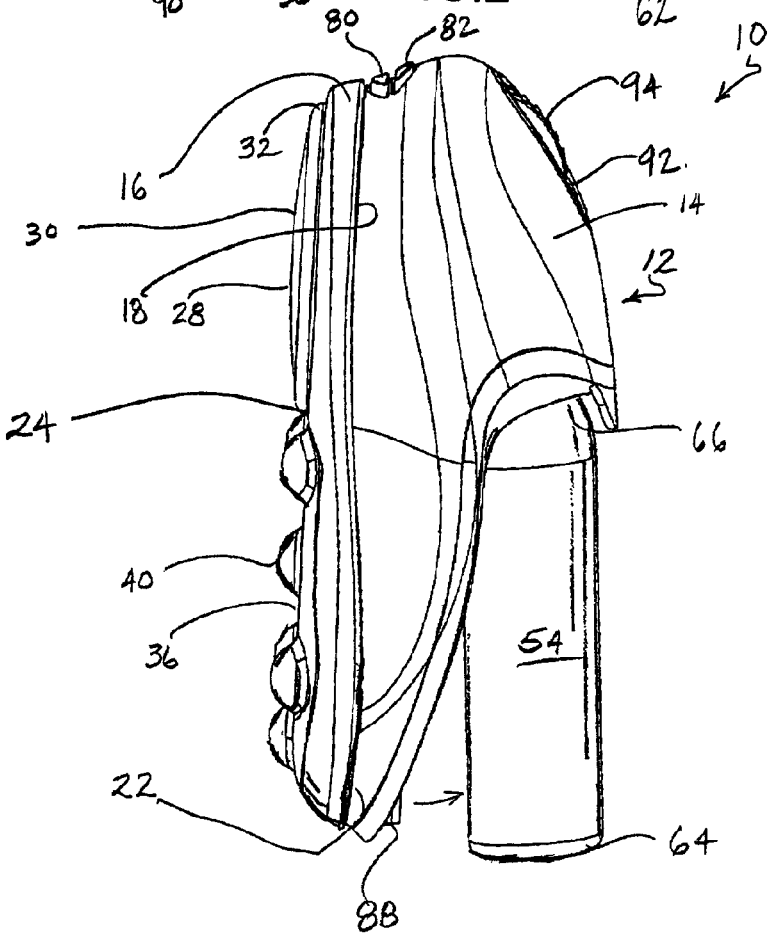
FIG. 2 is a side view of the massager of FIG. 1 shown in a generally vertical position with the reservoir cover removed.

Referring now to FIGS. 1 and 2, the present massager unit or device is generally designated 10, and includes a housing, generally designated 12. The housing 12, which is preferably made of injection molded plastic, is conceivably made from any durable, rigid material, including metal, wood and/or suitable engineered materials. An upper portion of the housing 12 is referred to as a gripping portion 14, and is preferably configured with an ergonomically "friendly" shape which is easily gripped and comfortably held for extended periods of time. If desired, gripping may be enhanced with textured surfaces and/or resilient pads (not shown) which are fastened or insert molded into the housing 12.

A lower portion of the housing 12 is referred to as a body-contacting portion 16, which, at its upper end 18 is provided with a resilient gasket 20 which sealingly engages a corresponding lower edge 22 of the gripping portion 14 to prevent the unwanted entry of massaging liquid. The sealing engagement is enhanced by the provision of a U-shaped groove in the upper portion of the gasket 20. The gasket 20, which extends substantially about the entire periphery of the engaging portions 14, 16 provides a shock isolation function described in further detail below.

A lower surface 24 of the body-contacting portion 16 is generally planar for providing as large a contacting surface as possible. The body-contacting portion 16 defines a tray for accommodating heating, vibrating and massaging liquid dispensing assemblies, as well as at least one rechargeable battery 26. In the preferred embodiment, the battery 26 is a rechargeable DC 2,000 milliamp/hour (mah) type battery which is well-known in the art of hand-held appliances, and two such batteries are provided in the massager 10, however, the number and power range of the batteries may vary to suit the application. An important feature of the present massager 10 is the run time of the unit in its heating and massaging modes. It has been found that the present massager 10, equipped as described herein, will have a run time of approximately 40 minutes.

Figure 3:
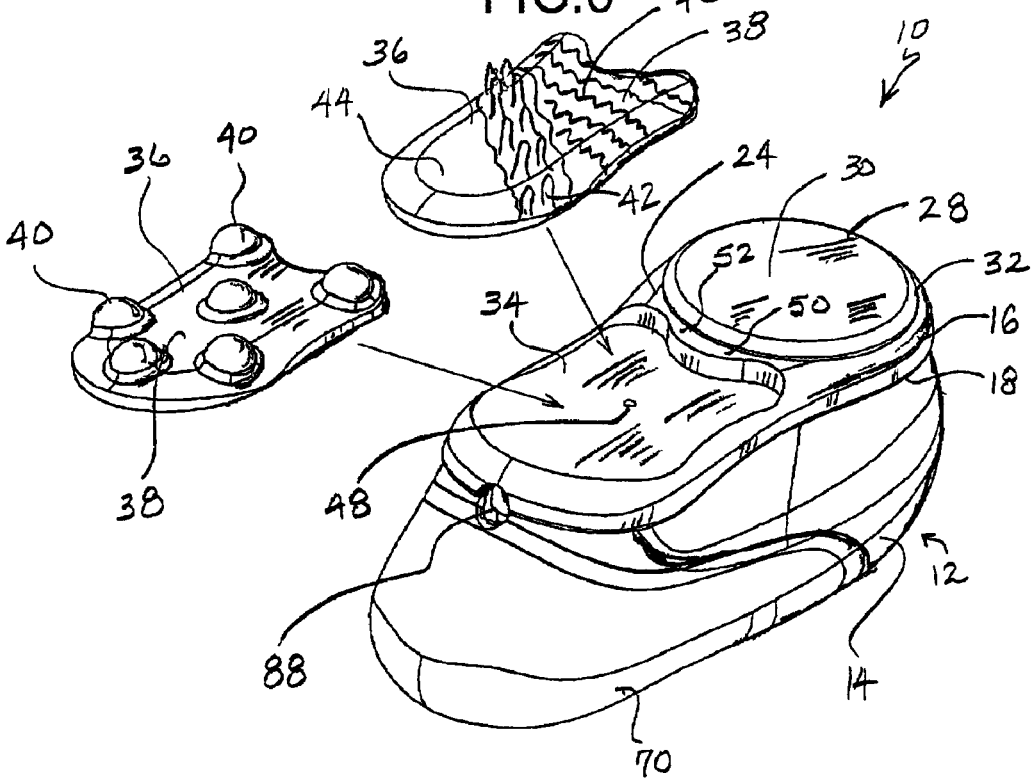
FIG. 3 is an exploded bottom perspective view of the present massager.

Referring now to FIGS. 1 and 3, an important feature of the present massager 10 is that the housing 12 is configured for emitting a massaging liquid, and also that the body-contacting portion 16 is configured for emitting heat to the target surface, typically skin. To that end, the lower surface 24 is provided with a heated applicator pad 28 having a generally planar contact surface 30 and a peripheral edge 32. The exact configuration of the surface of the pad 28 is not critical as long as it is capable of emitting sufficient heat as is desired over a suitable portion of skin, in relation to the size of the unit 10.

Also found on the lower surface 24 of the body-contacting portion 16 is a pocket 34 which is configured for receiving at least one massaging enhancement pad 36. In the preferred embodiment, the massaging enhancement pad 36 has a massaging surface 38 taken from the group including a plurality of spaced, dome-like massaging nodules 40, a plurality of fingers 42, a smooth surface 44 and textured pads 46. It is contemplated that the enhancement pad 36 is fastened within the pocket 34, either permanently or replaceably, however replaceable attachment is preferred. The fastening is achieved by chemical adhesives, ultrasonic welding, threaded fasteners tightened from within the housing 12 and passing through an aperture 48 in the pocket 34 or vice versa, a friction fit between a depending lug on the pad 36 (not shown) and the aperture 48. Other known attachment technologies are contemplated for securing the pad 36.

Between the heated applicator pad 28 and the enhancement pad 36 on the body-contacting portion 16 is located at least one fluid outlet 50 for emitting the massaging liquid disposed in close proximity to the heated applicator pad 28. In the preferred embodiment, there is one outlet 50 and one air vent aperture 52, however the number and size of the outlet and the vent aperture may vary to suit the application. It is also preferred, to enhance the massaging action of the unit 10, that the fluid outlet 50 is located adjacent the peripheral edge 32 of the heated applicator pad 28, so that soon after the emission of the massaging liquid, the heated applicator pad will heat both the liquid and the underlying skin. The operational motion of the individual using the unit 10 is preferably a circular one, so that the precise directional location of the outlet 50 is not critical as long as it is close to, and preferably next to, the edge 32.

Referring again to FIGS. 1 and 2, another feature of the present massager 10 is that the massaging liquid, whether it is an oil or a lotion, is provided in a reservoir 54 which is removably secured to the massager. In the preferred embodiment, the reservoir 54 is a conventional threaded plastic bottle of the type in which massaging liquids are commonly sold. An advantage of the present reservoir 54 is that it is removably secured to the unit 10 to minimize spillage during refilling. This advantage is achieved by providing a pivoting reservoir mount, generally designated 56 located within the housing 12 and preferably taking the form of a threaded cap-like receptacle 58 which is freely pivotable upon a pair of spaced legs 60. The receptacle 58 is internally threaded to threadably engage the reservoir 54. Alternatives to threading, such as bayonet mounts, snap fits or the like are also contemplated for removably securing the reservoir 54 to the receptacle 58 depending on the application.

The receptacle 58 has a pair of laterally projecting lugs or stub shafts (not shown) which engage sockets (not shown) in each leg, while it is also contemplated that the arrangement could be reversed, as is well known in the manufacturing art. Each of the legs 60 is secured to a vibrator motor housing 62 which in turn is preferably integrally molded into, or otherwise fastened to, the body-contacting portion 16 of the housing 12. In the preferred embodiment, the legs 60 are integrally molded to the motor housing 62, however other known fastening technologies are contemplated as described above. Once installed in the receptacle 58, the reservoir 54 is positioned on an incline, with a rear or bottom end 64 being lower than an upper or top end 66. The inclination facilitates the escape of air from the reservoir 54 as the massaging liquid is withdrawn, as described in greater detail below. In addition, the angle of inclination of the reservoir 54 during normal use facilitates use of the massager 10 upon a person laying flat or sitting in a vertical position.

In the operational position, the bottom end 64 rests on a housing support wall 68, and is held in place by a removable reservoir cover 70, which is part of the gripping portion 14 of the housing 12 and is attached thereto with a friction fit or other suitable known latch or fastening technique. The reservoir cover 70 retains the reservoir 54 in position while the unit 10 is in use, even when vibrating.

The reservoir 54 is easily accessed by removing the reservoir cover 70, and the refilling operation is accomplished by placing the unit 10 in a generally vertical position (best seen in FIG. 2). This position allows the reservoir 54 to freely pivot between an operating position (FIG. 1) to a generally vertical refill position (FIG. 2), which permits it to be readily removed by unthreading, remotely refilled, and replaced without spilling the massaging liquid.

Figure 4:
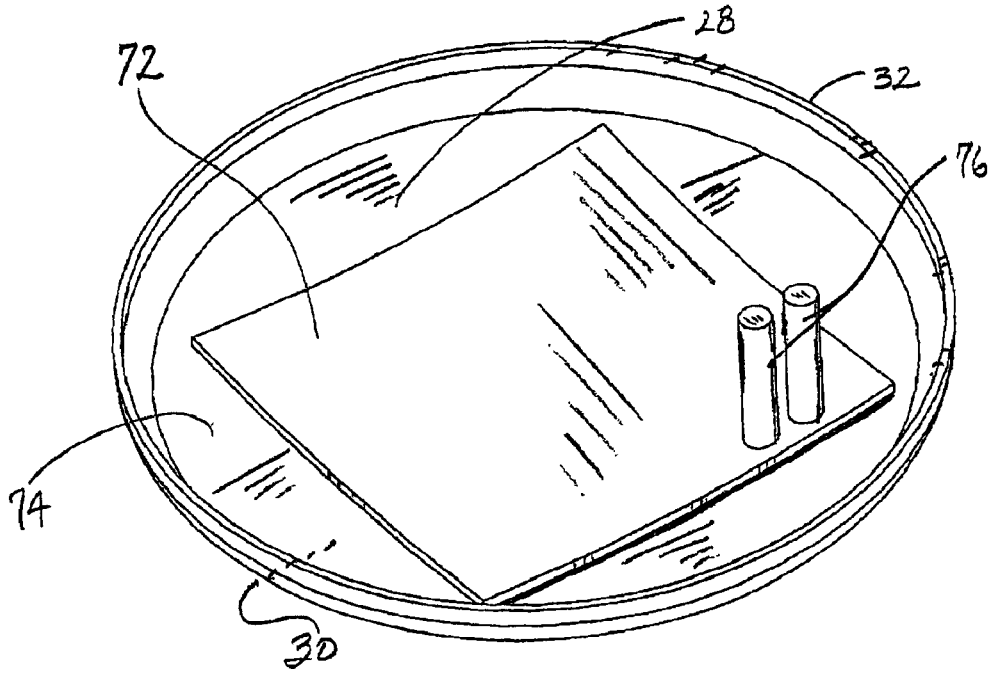
FIG. 4 is a top perspective view of the heating element of the present massager.

Referring now to FIGS. 1 and 4, the heated applicator pad 28 is heated by a Printed Thick Film (PTF) pad 72 which is secured, as by adhesive or fasteners, to an underside 74 of the pad 28, and is provided with a pair of leads 76. PTF technology is well known in the art and such pads are widely available. The leads 76 are electrically connected to a printed circuit board 78 as is known in the art, to which is also connected a variable heat control switch 80. In the preferred embodiment, the switch 80 is a three-position position switch with Off-Low-High settings for the amount of heat to be emitted. Other types of switches are contemplated depending on the application.

Above the switch 80 is another switch 82, which is used to control the amount of vibrations emitted by the massager 10. Like the switch 80, the vibration control switch 82 is a three-position switch having Off-Low-High positions, and is connected to the circuit board 78. The switch 82 is electrically connected to a vibration generator, which is preferably a vibrator motor 84 (shown hidden). In the preferred embodiment, the motor 84 is disposed within the motor housing 62 and is provided with at least one eccentric weight 86 (shown hidden) which is fixed to the rotating motor shaft (not shown) as is known in the art to provide a source of vibration. The vibrations thus produced are transmitted through the body-contacting portion 16 to the surface of the skin of the individual receiving the massage.

The gasket 20 described above, which seals the seam between the gripping portion 14 and the body-contacting portion 16, and has an upper groove for receiving the lower edge 22 of the gripping portion, also partially isolates the body-contacting portion by dampening the vibrations generated by the motor 84. The gasket 20 creates a resilient barrier between the two housing portions 14, 16. In the preferred embodiment, the vibrator motor 84 is configured to operate in the approximate range of between 1,500 to 4,000 rpm, with a preferred High Speed in the range of 3,600 rpm.

Referring again to FIG. 1, since, in the preferred embodiment 10, the batteries 26 are rechargeable, a recharging socket 88 is provided to receive the transformer adapter (not shown). Once recharging commences, an LED 90 becomes illuminated. The switches 80, 82, the charging socket 88, the LED 90 and the batteries 26 are connected to the circuit board 78 using conventional circuitry and resistors as is well known in the art.

Figure 5:
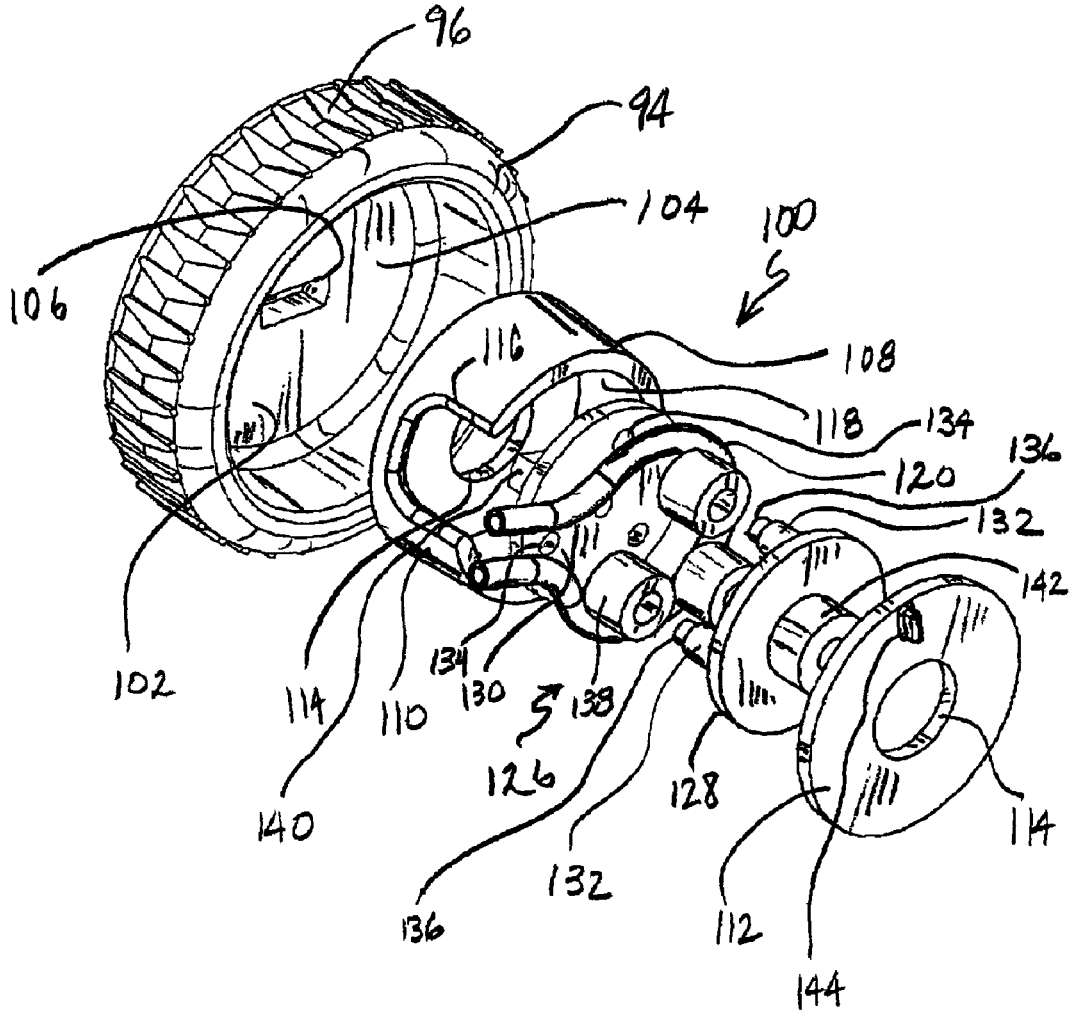
FIG. 5 is an exploded perspective view of the pump assembly and actuator wheel of the present massager.

Referring now to FIGS. 1 and 5, another feature of the present massager 10 is that in the housing 12 a cavity 92 is defined in the gripping portion 14 for receiving a massaging liquid actuator wheel or thumbwheel 94. The rotating actuator wheel 94 preferably has a textured exterior 96 and is the control mechanism for the amount of massaging liquid dispensed from the liquid outlet 50. The preferably central location on the housing 12 means that the user may obtain effective massaging liquid control with either right or left hand.

A pump, generally designated 100, is also provided for drawing the massaging liquid from the reservoir 54 and causing it to flow from the liquid outlet 50 in desired amounts. In the preferred embodiment, the pump 100 is under manual control, however powered pumps are also contemplated. Another feature of the present invention is that the pump 100 is located within a pump chamber 102 defined by the thumbwheel 94. The pump chamber 102 is defined by a web 104 of the thumbwheel 94 and the exterior actuation surface 96, which together provide a generally bowl shape to the pump chamber 102. A keyway or slot 106 is axially located in the web 104. A generally circular pump housing 108 is configured for disposition within the pump chamber 102, has a main portion 110 and a disk 112, both of which have axial openings 114. The disk 112 is configured to be snap fit or otherwise secured to the main portion 110, which also defines a flexible hose inlet/outlet 116. In addition, the main portion 110 defines a raceway 118 for receiving a length of flexible tubing 120, which is part of a long piece of tubing 122 leading from the reservoir 54, out through an outlet 124 in the receptacle 58, through the pump 100 and also being in fluid communication with the liquid outlet 50.

A roller assembly 126 is dimensioned for enclosure in, and relative rotation to the pump housing 108. The assembly 126 includes a pair of opposing circular plates 128, 130, the former provided with at least two bushing axles 132, and the latter with a corresponding number of bushing axle locator openings 134 dimensioned for receiving ends 136 of the axles 132. A like plurality of tubular bushings 138 is provided, each of which being mounted for rotation upon a corresponding one of the axles 132. The number of bushings 138 and axles 132 determines the output volume of the pump 100. The raceway 118 is defined between the exterior of the bushings 138 and the interior of the pump housing 108, and is dimensioned so that, upon rotational movement of the pump actuator wheel 94, the bushings press into or squeeze the flexible tubing 120 against the inner wall of the pump housing to create a peristaltic pumping or squeezing action. A portion of the massaging liquid can be moved through the hose 122 by this peristaltic squeezing action.

An opposite side of the plate 130 has a key 140 configured for engaging the keyway/slot 106, and an opposite side of the plate 128 is provided a boss 142 for matingly engaging the corresponding opening 114 in the disk 112 of the pump housing 108 for support. A lug 144 is provided on the disk 112 for engagement with the housing 12 in a way to prevent rotation of the pump housing 108. On the other hand, the roller assembly 126 is rotatable with the actuator wheel 94.

A vacuum is created behind each bushing 138, which also serves to draw additional liquid from the reservoir 54. To replace the withdrawn fluid with air, the reservoir 54 is provided with a flexible vent hose 146 (FIG. 1) which is in fluid communication with the interior of the reservoir, the cap-like receptacle 58 and the air vent 52. In the preferred embodiment, the vent hose 146 is made of the same flexible tubing material as is the flexible hose 122, however it is contemplated that different materials may be used, since the former transports air, while the latter transports massaging liquid.

One end of the vent hose 146 is attached to and in communication with the cap-like receptacle 58, as is the flexible 122, which also is in communication with a corresponding opening in the receptacle. A third opening in the receptacle-cap 58 is used to connect a length of hose 148 which extends to the rear or bottom end 64 of the reservoir 54 to fully drain the reservoir.

In operation, pumping action is started by manually rotating the pump wheel 94 in one continuous direction. Through this rotation, a vacuum is induced within the flexible hose 122, pulling fluid through the short curved tube 148. The massaging fluid travels into the pivoting bottle cap-receptacle 58 and into the flexible hose 122, ultimately into the length of tubing 120, and into the pump 100. As the pump 100 rotates, the roller bushings 138 positioned on the axles 132 come in contact with the flexible tubing 120 and compresses the flexible tubing in the raceway 118 against the pump housing 108, creating a low pressure vacuum on an aft portion of system, towards the batteries 26, and a high pressure, pushing motion on a forward portion of system, towards the switches 80, 82.

As the roller assembly 126 rotates toward the inlet/outlet 116, the fluid is pushed along at a closed off metered volume. The precise size of the metered volume is dependant upon the inner diameter of the flexible tubing 120 and length of inner flexible tubing between bushing compression points (bushings 138). As the rotating roller bushings 138 encounter the open area within the outer pump housing 108, the compressed tubing 120 expands back into its original shape, releasing the metered volume, allowing the high pressure to push the fluid through the flexible hose 122. The flexible hose 122 is attached to a boss (not shown) with an inner hole in communication with the outlet 50, allowing the massaging liquid to be dispensed from the unit 10.

During the pump operation, the air vent 52 provides a positive pressure vent to normal atmospheric pressure allowing the massaging fluid to dispense. The vent tube 146 is connected to a boss with an inner hole on pivoting bottle cap at the highest position available and is connected to the air vent 52 at the lowest possible position. This allows normal atmospheric pressure to travel through the vent tube 146 and vent the reservoir 54.

Thus, it will be seen that the present massager 10 provides the capability of emitting heat and a massaging liquid, as well as vibration, from the same hand-held unit. By using the manual pump 100, and the vibrator motor 84 generating vibrations in the range of 1500 to 4,000 rpm the present massager 10 can operate for 40 minutes with two 2,000 mah batteries 26. Also, the type of fluid can easily be changed by placing the unit 10 in a vertical position, removing the reservoir and replacing it with another, or by cleaning it and replacing the fluid. If the reservoir is filled with isopropyl alcohol, the tubing 120, 122 can be flushed using the pump 100.

While a particular embodiment of the heated massager has been described herein, it will be appreciated by those skilled in the art that changes and modifications may be made thereto without departing from the invention in its broader aspects and as set forth in the following claims.

What is claimed is:

1. A hand-held massager, comprising:

a housing having a gripping portion and a body-contacting portion, said housing enclosing a pump and a massage liquid reservoir located within said housing, said pump being in fluid communication with said reservoir and being provided with manual volume control of the dispensed massaging liquid;

said body-contacting portion including a heated applicator pad which is generally planar and fixed to said body-contacting portion, said body-contacting portion being configured for emitting heat directly to a target body surface and said housing being configured so that the massaging liquid is emitted by said pump from said body-contacting portion under said manual volume control so that heat is applied by said body-contacting portion to the target body surface and to the emitted liquid;

a vibration generator disposed in said housing in operational proximity to said body-contacting portion for generating vibrations emitted by said body-contacting portion;and a pivoting reservoir mount located within said housing, said mount constructed and arranged for receiving said reservoir configured for retaining a supply of the massaging liquid and being pivotable between an operating position and a refill position.

2. The massager of claim 1 further including at least one fluid outlet disposed in close proximity to said pad for emitting the massaging liquid.

3. The massager of claim 2 wherein said heated applicator pad has an outer peripheral edge, and said at least one fluid outlet is disposed in close proximity to said edge.

4. The massager of claim 1 further including a variable control electrically connected to a heat emitter located on said body-contacting portion for controlling the amount of emitted heat.

5. The massager of claim 1 further including a variable control electrically connected to said vibration generator for controlling the amount of emitted vibrations.

6. The massager of claim 5 wherein said vibration generator is configured to operate in the approximate range of between 1500 to 4000 rpm.

7. The massager of claim 1 further including a power source of two 2,000 mah batteries, and wherein said vibration generator and said heat emitting portion of said housing are configured for operating for approximately 40 minutes.

8. The massager of claim 1 further including a vibration isolating gasket disposed between said gripping portion and said body-contacting portion.

9. The massager of claim 1 further including a pocket on said body-contacting portion of said housing and at least one massaging enhancement pad, said pocket configured for receiving said at least one massaging enhancement pad.

10. The massager of claim 9 wherein said at least one massaging enhancement pad has a surface taken from the group including massaging nodules, waves, fingers, smooth surface and textured pads.

11. The massager of claim 10 wherein said at least one massaging enhancement pad is removably attached to said pocket.

12. The massager of claim 1 wherein said housing further includes a removable reservoir cover, and said massager is configured so that, upon removal of said cover from said housing and the placement of said massager to extend in a generally vertically-oriented position, said reservoir mount pivots said reservoir in a generally parallel position relative to said body-contacting portion so that said reservoir assumes a generally vertical position for refilling.

13. The massager of claim 1, further including a combined actuator and pump assembly associated with said housing and configured for dispensing the massaging liquid from said body-contacting portion in desired amounts for being heated by said body-contacting portion on the target body surface, said assembly comprising:

an actuator wheel having an exterior actuation surface, at least one web joined to said actuation surface, said exterior actuation surface and said web defining a pump chamber;

a pump housing configured for disposition within said pump chamber;

a roller assembly being rotatable relative to said pump housing and being rotatable with said actuator wheel;

said pump housing defining a raceway for accommodating a length of flexible tubing and rotatably receiving said roller assembly in peristaltic relationship to said tubing;

wherein rotation of said actuator wheel causes rotation of said roller assembly relative to said length of flexible tubing to pump liquid through said tubing.

14. The massager of claim 13 wherein said pump housing is fixed relative to said housing, and said roller assembly is matingly engaged with said actuator wheel.

15. A hand-held massager, comprising:

a housing having a gripping portion and a body-contacting portion, said housing being configured for emitting a massaging liquid and said body-contacting portion being configured for emitting heat to a target skin surface;

a pump disposed within said housing for dispensing the massaging liquid;

a removable reservoir being in fluid communication with said pump; and said reservoir being pivotably mounted to said massager between an operational position in which said reservoir is inclined relative to said body-contacting portion, and a refill position in which said body-contacting portion is placed in a generally vertical position and said reservoir is in a generally parallel position relative to a body contacting surface of said body-contacting portion.

16. The massager of claim 15 wherein said gripping portion includes a removable reservoir cover configured for providing access to said reservoir.

17. A hand-held massager, comprising:

a housing having a gripping portion and a body-contacting portion, said housing enclosing a pump and massage liquid reservoir located within said housing, said pump being in fluid communication with said reservoir and being provided with manual volume control of the dispensed massaging liquid;

said body-contacting portion including a heated applicator pad which is generally planar and fixed to said body-contacting portion, said body-contacting portion being configured for emitting heat directly to a target body surface and said housing being configured so that the massaging liquid is emitted by said pump from said body-contacting portion under said manual volume control so that heat is applied by said body-contacting portion to the target body surface and to the emitted liquid;

a vibration generator disposed in said housing in operational proximity to said body-contacting portion for generating vibrations emitted by said body-contacting portion; and a thumbwheel associated with said housing for controlling said pump, said pump being disposed within a chamber defined by said thumbwheel.

* * * * *